United States Patent [19]

Benneyworth et al.

[11] Patent Number: 5,024,554

[45] Date of Patent: Jun. 18, 1991

[54] BRIDGE JOINT CONSTRUCTION

[75] Inventors: Douglas F. Benneyworth, East Sussex, England; Richard J. Baker, Cincinnati, Ohio

[73] Assignee: Koch Materials Company, Wichita, Kans.

[21] Appl. No.: 483,575

[22] Filed: Feb. 22, 1990

[51] Int. Cl.[5] ..... E01C 11/02

[52] U.S. Cl. ..... 404/74; 404/47

[58] Field of Search ..... 404/74, 47–49, 404/53, 87, 69, 66, 67; 14/16.1

[56] References Cited

U.S. PATENT DOCUMENTS

| | | | |
|---|---|---|---|
| 3,223,005 | 12/1965 | Carlson | 404/47 |
| 3,474,625 | 10/1969 | Draper et al. | 404/47 X |
| 3,827,204 | 8/1974 | Walters | 404/66 X |
| 4,279,533 | 7/1981 | Peterson et al. | 404/74 X |
| 4,324,504 | 4/1982 | Cottingham et al. | 404/74 |
| 4,601,604 | 7/1986 | Clark et al. | 404/69 |
| 4,784,516 | 11/1988 | Cox | 404/74 X |

FOREIGN PATENT DOCUMENTS

| | | | |
|---|---|---|---|
| 296377 | 12/1988 | European Pat. Off. | 404/74 |
| 2217479 | 6/1974 | France . | |
| 1318805 | 10/1971 | United Kingdom . | |
| 1407229 | 10/1972 | United Kingdom . | |

OTHER PUBLICATIONS

"Bituminous Materials in Road Construction", pp. 550–551.

Road Research Laboratory, Department of the Environment, "Full-scale road experiments using rubberized surfacing materials" by P. D. Thompson and W. S. Szatkowski, 1971.

*Primary Examiner*—Ramon S. Britts
*Assistant Examiner*—Gay Ann Spahn
*Attorney, Agent, or Firm*—Kokjer,Kircher,Bradley,Wharton,Bowman & Johnson

[57] ABSTRACT

A method for constructing a bridge joint in a channel overlying an expansion joint involves lining the channel with a thermoplastic asphaltic elastomeric binder followed by successive applications of layers of aggregate and binder mixture wherein the thickness of each layer is restricted to about the maximum dimension of the aggregate in the layer. Care is taken to insure that both the binder and the aggregate are hot when the layered joint is formed to insure good bonding between layers and with the roadway material. The aggregate of each layer is raked to project upwardly from the mass of the layer before a subsequent layer is applied to enhance the interlock between layers. A final layer containing smaller aggregate is applied at the joint top and the joint is then sealed and rolled to form an integrated, resilient load bearing structure.

10 Claims, 2 Drawing Sheets

BRIDGE JOINT CONSTRUCTION

The present invention is directed to highway construction, and more particularly to a method of constructing an improved joint in the pavement over the gap between adjacent slabs in a bridge.

BACKGROUND OF THE INVENTIONS

Typically, highway bridges are constructed of discrete concrete slabs supported on pillars and disposed end to end with an expansion gap between adjacent slabs. A continuous hot rolled asphalt roadway or concrete roadway is formed over the slabs to provide the bridge deck surface.

A common problem at bridge joint regions is cracking and deterioration of the asphalt and deck members. This deterioration is attributed to (1) expansion, contraction, or other movement of deck members which disrupts the asphalt layer above the expansion gap between slabs and (2) vehicular impact on the asphalt roadway immediately above the expansion gap. As weather conditions change, the concrete slabs contract or expand causing movement of the slabs in the gap region. The continuous asphalt roadway across the bridge surface and overlying the expansion gaps is pulled apart or crunched together in the region of the gaps due to the supporting deck movement. Cracks and potholes result in the asphalt. This is hazardous to drivers and also permits water and asphalt debris to penetrate the bridge construction where they can lead to deterioration of the supporting bridge structure.

A similar problem results from vehicular impact on the asphalt immediately above the gap or joint. If the asphalt is not properly supported from below at the gap region, impact stresses push the asphalt down into the gap area where it can break off the upper corners of the deck members. Water seeping into the structure will also expand or contract causing further cracking in the structure, and the debris from deterioration may fall into the gap blocking necessary free movement of the deck members.

An early solution attempted for this problem was to provide for a stronger support in the asphalt immediately above the joint. This was accomplished by cutting a channel in the asphalt surface about 30 cm wide at the location of the joint. Two strips of epoxy mortar were applied to the deck members on either side of the expansion gap and a continuous strip of plastic or rubbery sealing material wa applied immediately above the gap. The hardness of the material above the gap was intended to provide support so that vehicular impact stress would not cause deterioration. The hardness of the center rubber did prevent the asphalt from cracking directly above the gap. However, this hardness proved to be a disadvantage because it caused the softer surface on either side of the relatively harder strip to break up. Debris from cracking was not accommodated by the hard strip and this also exerted damaging pressure to surrounding areas.

More recently, attempts have been made to overcome these disadvantages. A method for sealing bridge deck joints by filling a channel cut around and above the gap with a flexible composition of chips of stone aggregate in a rubberized bitumen matrix is proposed in U.S. Pat. No. 4,324,504 to Cottingham. The rubberized bitumen matrix was composed of bitumen, tire crumb rubber, fine sand, and limestone powder. The rubberized binder was intended to bind the stone aggregate together so that the joint would have sufficient flexibility to withstand movement of the concrete slabs without the surface cracking. However, the solid support needed to withstand impact over the gap is not provided by the Cottingham joint. Vehicular impact stress causes the aggregate to move or jolt suddenly within the matrix, eventually breaking the bond with the rubberized matrix and ultimate deterioration of the joint.

OBJECTS AND SUMMARY OF THE INVENTION

Accordingly, it is a primary object of this invention to provide a method for constructing a bridge joint wherein the resulting joint is capable of providing necessary support for vehicular impact and yet the joint is also sufficiently flexible to withstand deck movement, thereby enhancing the effective life of the joint.

It is a further object of this invention to provide a method for constructing a bridge joint that resists cracking or deteriorating and which remains waterproof.

It is yet a further object of this invention to provide a method for constructing a bridge joint which has increased capability for transferring impact stress throughout the joint while maintaining the physical integrity of the joint.

It is still a further object of this invention to provide a method for constructing a bridge joint capable of achieving the foregoing objects, yet which is sufficiently flexible to withstand horizontal, vertical, lateral, or even rotational movement of underlying concrete decks while maintaining its physical integrity.

The present invention is directed to an improved method for constructing a joint in the pavement over a gap or joint in a bridge or similar structure. The invention comprises creating a channel in the roadway and sealing the channel defining walls with a polymerized asphalt binder having certain physical characteristics, and then filling the area above the gap with a series of layers of a mixture comprising crushed aggregate in such a polymerized asphalt binder. The aggregate is layered in a manner to provide for maximum support for loads applied to the joint from above and the binder coats the aggregate to bind the aggregate together elasticity. Each piece of aggregate is tied by the binder to the adjacent aggregate in the layer as well as to the aggregate above and below in adjacent layers. This layering allows the stresses to be dispersed throughout the system without breaking the bond between the pieces of aggregate and the binder. The road surface at the joint will retain its integrity even though stressed by movement within the lower deck slabs and by vehicular impact. The joint accommodates horizontal, lateral, vertical rotational and vibrational stresses while preserving a comprehensive weather seal over the bridge structure.

DETAILED DESCRIPTION OF THE DRAWINGS

Figure 1:
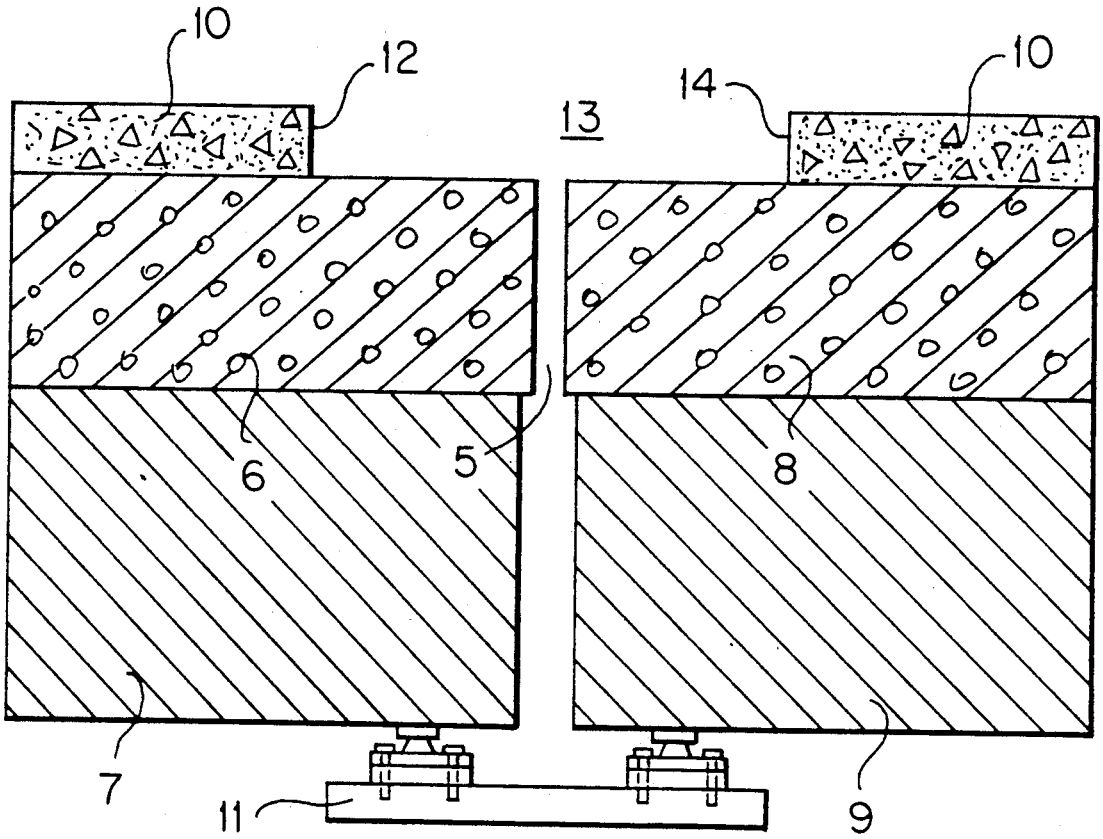
FIG. 1 is a vertical cross-sectional view through a typical bridge showing a channel cut in the asphalt overlay as an initial step in constructing a joint pursuant to the principles of this invention.
Figure 2:
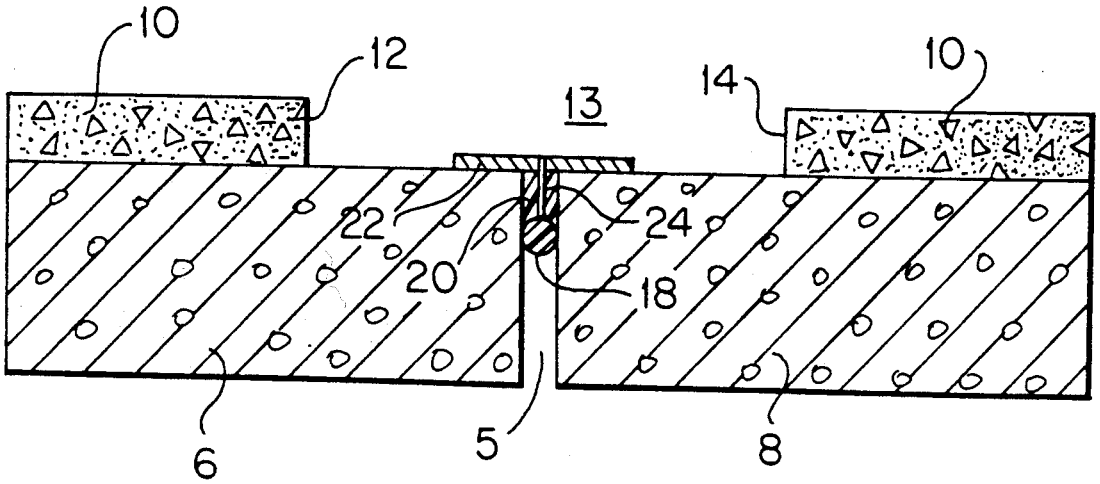
FIG. 2 is a view similar to Fig. 1 but showing only the slabs and roadway with a bridge plate installed at the joint.
Figure 3:
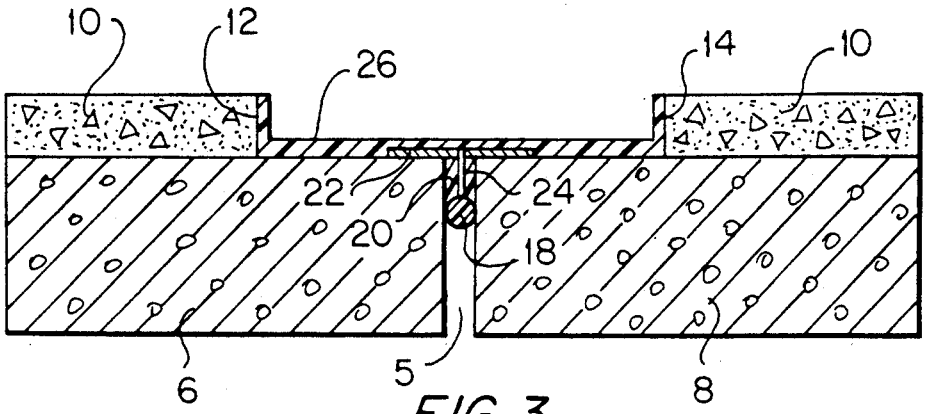
FIG. 3 is a view similar to FIG. 2 illustrating the waterproofing of the channel.
Figure 4:
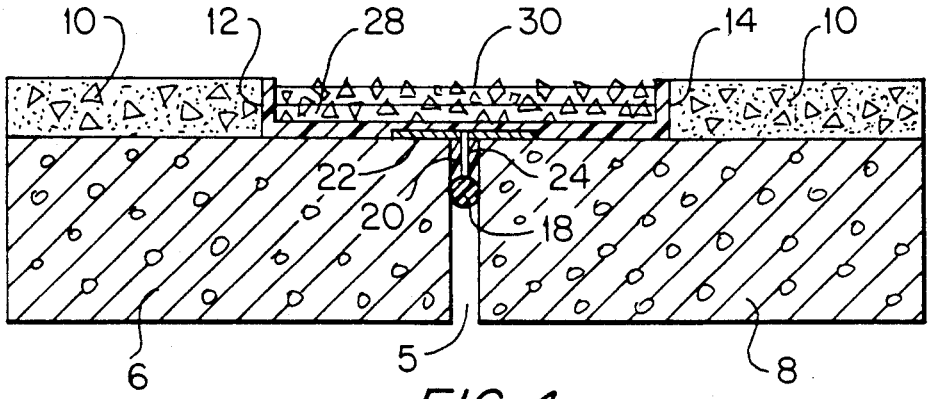
FIG. 4 is a view similar to FIG. 3 illustrating two interlocked layers of aggregate and binder mixture in the joint.
Figure 5:
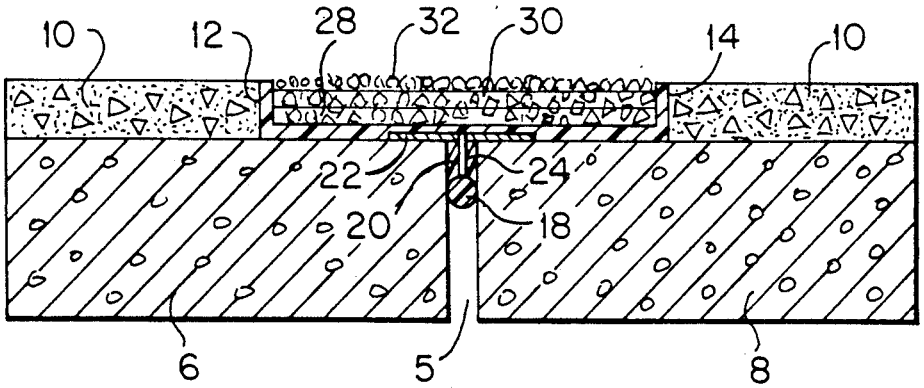
FIG. 5 is a view similar to FIG. 4 but showing the joint after an additional mixture layer has been added and the aggregate raked.
Figure 6:
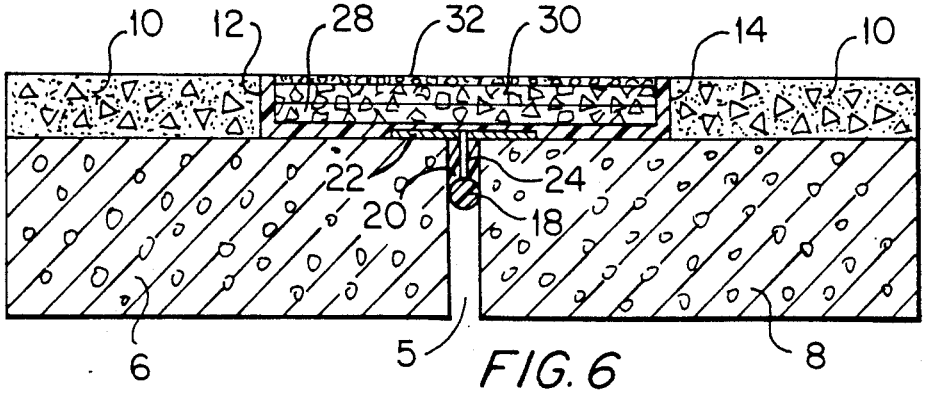
FIG. 6 is a vertical cross-sectional view similar to FIGS. 2–5 but showing the completed joint.

Referring initially to Fig. 1 of the drawing, a typical bridge comprises a series of end to end slabs, such as slabs 6 and 8, supported by longitudinally extending girders 7 and 9. The longitudinal girders are, in turn, supported by a support member such as pillar 11 extending from the ground to support the slabs in positions elevated above ground level.

To accommodate relative movement such as contraction and expansion of bridge construction members from temperature variations, the members such as girders 7 and 9 and slabs 6 and 8 are spaced apart at abutting ends with a gap therebetween. The gap allows the members to expand and contract without buckling or otherwise damaging the members. In the typical bridge joint illustrated in Fig. 1, the slabs 6 and 8 are of reinforced concrete material, extend the full distance laterally across the bridge roadway, and the gap between adjacent, abutting ends of the respective slabs is designated by the numeral 5. It will be understood that the ends of the respective girders 7 and 9 opposite the ends shown in the drawing are supported in similar fashion to that shown in the drawing. Further, although a single bridge joint is illustrated to describe the principles of this invention, a bridge normally would have a similar joint at each junction between adjacent slabs of the bridge.

The purpose of the bridge is to support a roadway for vehicular traffic. The roadway comprises a layer 10 of bituminous paving material which extends the width of the roadway and is normally placed as a continuous band of uniform thickness extending from one end of the bridge to the other and across the gaps 5 at the respective bridge joints. Typically, the spacing between slabs 6 and 8 at a gap 5 is about 2 to 3 centimeters at ambient temperatures in the range from 15° C. to 20° C. The gap 5 may vary from a minimum of about 0.5 centimeter under hot summer conditions to as much as about 4.5 centimeters in cold winter conditions.

As described above, both the movement of the slabs at the gap 5 and the leaving of the roadway layer 10 unsupported by underlying slab material to create the gap results in cracking or braking of the layer 10 in the region proximal the gap. It has heretofore been recognized that a possible solution to this problem is the replacement of the bituminous roadway material 10 at the region of the joint with a section of material better able to resist damage the special stresses applied to the material at the joint region without damage to the section. While efforts of this type have alleviated the problem to a degree, they have not been entirely successful in creating a joint capable of reliable service over a relatively long period of time.

The term "joint" is sometimes used in this art to mean the zone of juncture between bridge members which are free to move relative to each other. The term is also used to mean the material of the roadway proximal the juncture of bridge members. The term "joint" is used in both senses in this application and those skilled in the art will have no difficulty in differentiating between the meanings to be given the term from the context in which the term is used.

The method of constructing the bridge joint of this invention differs from methods heretofore used both in the choice of certain materials used and in the steps carried out in the construction process. However, the initial steps of preparing the roadway prior to construction of the new joint are the same as have been used before. Thus, the overlay material 10 is cut and completely removed from slabs 6 and 8 to create a channel 13 about 20 to 24 inches wide overlapping about equal distance each slab and extending the full width of the roadway. Preferably, the end edges 12 and 14 of channel 13 are smooth, straight and clean with no rough or jagged edges because a better bond and more uniform final surface can be achieved with straight edges of this kind.

At this point it is desirable that the channel 13 should be thoroughly cleaned and dried as is conventional before proceeding further with the construction of the joint. A hot compressed air lance capable of producing flame-retarded air stream air stream temperatures up to 3000° F. and velocities up to 3000 feet per second have been found useful for removing all water and debris from the channel.

Also conventionally, the gap 5 should be closed to permit casting of the materials comprising the constructed joint in situ without gravitation of the materials from the channel before the liquid component has hardened. Further, the gap should be sealed to prevent ingress of deleterious moisture to the newly constructed joint from below, and a physical shield should be placed over the upper end of the gap to prevent abrasion to the joint material from upper corners of the slabs as they move relative to the joint during construction and expansion.

To this end, an oversized, closed-cell transversely plastic foam rod 18, commonly called a "backer rod", is fitted in expansion gap 5 near the upper end of the gap as illustrated in the drawings. The rod 18 is squeezed into the expansion gap to a position approximately four to six inches below the upper surfaces of the gap defining slabs 6 and 8 and the rod extends continuously across the roadway. Rod !8 serves as a stopper for sealing the gap and is resiliently deformable for accommodating changes to the transverse dimension of the gap which results from relative movement such as contraction and expansion of the bridge members. The rod functions to prevent foreign materials from gravitating into the gap, therefore there should be no interruption in the continuous extension of the rod the entire length of the gap across the roadway.

Following installation of the backer rod 18, the remaining volume of gap 5 above the rod is filled with a sealant 20 poured while hot into the gap. Preferably, the top of material 20 is almost level with the top surfaces of slabs 6 and 8, but extends in a slightly concave fashion between the slabs. A variety of different materials are suitable and are used for this purpose. Sealants such as silicone, polysulfide, polyurethane may be used. Preferably, the thermoplastic asphaltic elastomeric binder material, hereinafter described in connection with applicant's novel construction method, is used for this purpose.

After the gap is filled with sealant, a layer of sealant is applied to the bottom floor of the channel, completely covering the upper end of gap 5 and the exposed surfaces of adjacent concrete slabs. A bridge plate 22 is then placed on top of the sealant layer over the upper end of gap 5 to cover the gap and sealant. The plate extends the full width of the roadway and typically comprises a strip of mild steel or aluminum about 4 to 6 inches wide and about one-fourth inch thick. Plate 22 is centered over the gap as shown in the drawings and is secured in place by spikes 24 inserted through holes drilled through the plate and extending through sealant material 20 to backer rod 18 but preferably not penetrating the rod. Plate 22 insures that the upper end of gap 5 is covered by the plate at all times, despite contraction and expansion of the slab members. The sealant layer between the plate and concrete slabs permits relative movement of slabs with respect to the plate without damage to the slabs.

The preparation of the roadway for construction of the bridge joint heretofore described is conventional. The steps to be described subsequently differ importantly from those heretofore used. It is believed that these differences contribute significantly in the substantial increase in durability and performance achieved by joints constructed pursuant to applicant's novel method.

The joint of this invention consists essentially of a mixture of stone aggregate and a binder which binds the aggregate together in a manner permitting elastic deformation during transfer of loads from the roadway to the support slabs without cracking or breaking the coherent mass of joint material and without breaking the joint material from the asphalt roadway layer 10. The binder material is not novel per se, but the material is used in a novel manner with especially selected aggregate to produce a vastly superior joint.

Preferably following installation of plate 22, channel 13 is again cleaned with the hot air lance to insure that all surfaces of the channel are clean and dry. A sealant material 26 is then applied as a coating uniformly over all surfaces of channel 13 to completely seal the bottom and end walls of the channel. Preferably this coating 26 is about one-eighth inch thick. Applicants prefer to use for this purpose a thermoplastic asphaltic elastomeric binder material which they have found particularly well suited for use as the binder to be mixed with the stone aggregate.

This binder material must be capable of bonding well with other materials and yet must be sufficiently flexible and strong to permit relative movement between the respective aggregate pieces without disbondment. This movement results from loads encountered by the joint. The binder material can be any of several commercially available crack and joint sealants having certain physical properties. The material should preferably have a major component of asphalt with constituent of Styrene-Butadine block co-polymer, rather than a constituent of crumb rubber as is used in the joint material described in the Cottingham U.S. Pat. No. 4,324,504.

We believe it is important that the binder material used in this invention have certain desirable physical properties. We prefer that the binder material meet the following specifications in accordance with ASTM standard test procedures for materials of this type:

| | |
|---|---|
| Softening point | 180° F. |
| Penetration (77° F., 150 G., 5 sec.) | 90 MAX. |
| Penetration (0° F., 200 G., 60 sec.) | 10–20 |
| Resilience (77° F.) | 60% MIN. |
| Flow Temperature (140° F./60° C.) | 3 mm. MAX. |

-continued

| | |
|---|---|
| Bond (−20° F., 3 cycles, ½" specimens) | 50% |
| Ductility (77° F., 5 cm./min.) | MIN. 40 |
| Tensile Adhesion | 700% MIN. |

For applications where service is to be in cold weather conditions (prolonged periods of 0° F. or lower), the binder used may be softer, i.e. the penetration at 77° F. should be between 90 and 150 and at 0° F. (100 G., 5 sec.) should be 40 minimum. The resilience (77° F.) should be 75% minimum and Bond (−20° F., 3 cycles, ⅜" specimens) should be 200%. The tensile adhesion should be 1000%. Otherwise, the physical properties of the cold weather binder should be the same as described above for the binder material.

The binder material should be heated to a temperature in the range of about 365° F.–390° F. with continuous agitation. To prevent damage to constituents of the binder, it is desirable to avoid heating the binder by direct contact with a flame. A jacketed kettle heated with hot oil, for example, is preferred for heating the binder material. Immediately after heating, the hot binder is then applied to the walls and bottom of channel 13 as described above to form a monolithic, seamless, waterproof covering 26 around the walls defining the open top channel.

After coating 26 is applied to the channel, the joint is constructed by the systematic superimposition of a series of layers of aggregate and binder mixture until the channel !3 is filled. The aggregate size is correlated with the thickness of each layer of aggregate and binder mixture in a manner to create a joint having far greater durability than previous "mixed in place" joints.

The aggregate used in constructing the joint should have angled faces with relatively sharp edges therebetween, rather than comprise relatively rounded stones. Desirably, the aggregate is a hard stone such as granite or the like having a CaO content of less than 5% and which meets the specification common in the construction industry wherein a substantial percentage of the aggregate pieces have at least two fractured face resulting from crushing. The aggregate should be double washed and dried.

Aggregate of relatively uniform size (nominally ¾") is used for constructing all but the uppermost layer of the joint. The preferred gradation for the aggregate is:

| Percent Passing | Sieve Size |
|---|---|
| 95–100% | ¾" |
| 30–50% | ⅜" |
| 10–25% | ½" |
| 0–10% | ⅜" |

The aggregate is heated to a temperature within the range of 200° F.–275° F., preferably 250° F. A method for heating the aggregate which has been found acceptable is to place the aggregate in a portable mixer and heat the aggregate by positioning a hot compressed air lance on a tripod in a manner to discharge heated air about two feet from the mouth of the mixer. Heated binder is then added to the hot aggregate in a ratio of about 25–27 parts binder to about 73–75 parts aggregate by weight to form the mixture for the first layer of material to construct the joint.

Immediately prior to pouring the aggregate and binder mix into channel 13, the channel, and particularly lining 26, should be reheated with the hot air lance to at least about 200° F.–250° F. The hot aggregate and binder mixture bonds with the heated binder material which comprises lining 26, thereby creating a relatively seamless, fused juncture.

The hot aggregate/binder mixture is placed in the channel to a depth wherein there is essentially but a single layer of aggregate in the mixture layer 28. In other words, there should be little or no stacking of aggregate pieces on one another in the layer 28. Therefore, taking into account the volume of binder in the mixture layer, the thickness for the mixture layer 28, when using ¾' aggregate, should be from about ¾' to about 1'.

After layer 28 has been permitted to set for a few minutes, heated binder material is poured over the layer 28 to fill any voids within the layer and to form a flat and even surface for the top of the layer. This insures that there is adequate binder present at the top of an underlying layer for effecting a good bond with the next adjacent layer as will be subsequently explained.

Once the binder material in layer 28 has cooled a few minutes so that the viscosity of the binder is great enough to hold the stone, the particles of aggregate are manually agitated or raked with a garden rake or the like to turn a substantial amount of the aggregate particles into positions projecting upwardly from the top surface of the layer. The purpose of this step is to produce a jagged or roughened surface on the layer top to enhance the bond with the succeeding layer of material.

After the raking step, the top surface of layer 28 and the liner 26 on the adjacent vertical edges 12 and 14 of the channel are again reheated with the hot air lance as described above. Another layer 30 of hot aggregate and hot binder mixture a described above is poured in the channel in the same manner and to the same thickness as described with respect to layer 28. The step of pouring hot binder over the mixture layer after it has cooled slightly is repeated to fill any voids, and the aggregate in layer 30 is raked up as previously described. It will be readily understood how this step of elevating some of the aggregate to project from the top of one layer into the space to be occupied by a succeeding layer creates an excellent interlock between the respective layers. This mechanical interlock which is maintained by the layer of binder which completely coats each aggregate particle and binds each particle to the adjacent particles renders the joint especially capable of withstanding impactive loading as will be subsequently explained more fully.

The process of creating and placing layers of binder and aggregate mixture as described above is continued until the resulting joint of built up material is within ¾' or less of the top of channel 13. Depending, of course, on the depth of the roadway layer 10, this usually requires from 2 to 8 layers for a typical joint construction.

A final or top layer 32 comprised of a mixture of substantially smaller aggregate and binder (of the type described above) is then applied over the channel and is compacted into the underlying layers. The aggregate for layer 32 should be of relatively uniform size, preferably nominally about ½', and should otherwise have the characteristics previously described with respect to the larger aggregate.

The preferred specification for the ½' aggregate is:

| Percent Passing | Sieve Size |
|---|---|
| 90–100 | ½" |
| 40–70 | ⅜" |
| 10–20 | No. 4 |
| 0–10 | No. 8 |

The ½' aggregate for top layer 32 is heated as heretofore described and is mixed with hot binder in the manner and in about the same proportions described for the coarser aggregate mix. The upper surface of the top coarser aggregate layer 30 and the coating 26 remaining above layer 30, are heated with the hot air lance. The ½' aggregate and binder mixture is applied over layer 30 to a depth of about 174 ' to ½' above the upper surface of the adjacent roadway layer 10. After layer 32 has cooled a few minutes, the layer is compacted to force the aggregate down into the joint to a point where no further compaction can be achieved. The preferred way of compacting layer 32 is by the use of a twin steel wheel roller of a minimum capacity of about 1 ton. The roller should be wet to prevent the mixture from sticking to the roller. The entire joint should be rolled to compact the aggregate in the mixtures within the various layers so that the aggregate constitutes a more or less homogeneous interlocked system, each stone bound to the neighboring stones by a relatively thin layer of yieldable binder, creating a body capable of transmitting rather substantial loads from one piece of aggregate to another in the body, to the supporting slabs.

After the joint has been constructed layer at a time followed by compaction, the joint is sealed by spreading layer of the hot elastomeric binder material over the entire joint surface to fill any surface voids. The covering layer of binder is leveled to a flat, level surface even with the upper surface of the proximal roadway layer !0. This top surface 34 is then dusted with silica sand, portland cement, mineral filler or other fine aggregate prior to opening the roadway to traffic to prevent damage to the joint from tires sticking to the elastomeric binder.

It has been found that joints constructed as described herein are substantially more durable than heretofore available bridge joints, including joints which are formed in place of this general type. Almost certainly the layered construction wherein the thickness of each layer is restricted to about the size of the aggregate in the mixture contributes to this enhanced performance. When the layers are interlocked as described and the aggregate compacted in the mass as described, the resulting body is particularly capable of handling the forces from traffic loads in a manner uniquely necessary at bridge joints. The tightly compacted aggregate pieces bound together by the flexible elastomeric binder are capable of bearing and transmitting from one to the other the substantial loads from traffic impacts. These loads must be transmitted downwardly through the body of material to the load supporting slabs. Those which occur directly over the expansion gap must also be transmitted laterally to reach the supporting slabs.

The joint constructed a herein described has been found capable of withstanding the loading at bridge joints without the disbonding of some of the aggregate from the binder material which has been characteristic of previous joints of this general type.

We claim:

1. A method of constructing a bridge joint in a channel which has been lined with elastomeric material, said channel overlying the expansion gap between structural members, said method comprising:

applying a mixture of aggregate and elastomeric binder material as a base layer of said mixture in the bottom of said lined channel;

applying at least one or more succeeding layers of said mixture in the channel over said base layer to fill the channel to within ¾" of the top of said channel, the size of said aggregate in said base and succeeding layers being substantially uniform, the thickness of each layer being restricted to about the maximum size of said aggregate; and applying a top layer of said mixture to complete the filling of channel, the aggregate in said top layer being substantially smaller than the aggregate in the layers below said top layer.

2. A method as set forth in claim 1, wherein the maximum aggregate size in the layers below said top layer is ¾".

3. A method as set forth in claim 1, wherein the aggregate and the binder of said mixture are heated before being applied in said layers.

4. A method as set forth in claim 1, wherein a substantial portion of the aggregate in each layer is positioned to project upwardly beyond the layer mass prior to the step of applying a succeeding layer, thereby enhancing the interlock between adjacent layers.

5. A method as set forth in claim 4, wherein a coating of hot elastomeric binder material is applied over each layer after the latter is applied in the channel and before said aggregate is positioned to project upwardly, wherein said coating fills any voids in the layer of mixture.

6. The method of claim 1, wherein compressive forces are applied to the superposed layers in the channel from the top of said channel.

7. In the construction of a bridge joint, an improved method of producing a composite aggregate and elastomeric binder filling for a channel overlying the expansion gap between structural members, said method comprising:

applying a mixture of aggregate of substantially uniform size and elastomeric binder material in a layer in the channel, the thickness of said layer being held to about the size of the aggregate in the layer; and continuing the application of one or more further layers of said mixture of aggregate of substantially uniform size and elastomeric binder successively with each succeeding layer being applied above the next preceding layer and with the thickness of each layer being kept to about the size of the aggregate in that respective layer, until the quantity of said filling in the channel reaches substantially to the top of said channel.

8. The method of claim 7, wherein the method includes the step of mechanically contacting a portion of the aggregate in each layer except the top layer of the filling and prior to the application of the next layer, to physically position some of the contacted aggregate into positions projecting upwardly from the corresponding layer in dispositions to interlock with the next layer to be applied.

9. The method of claim 8, wherein said aggregate contacting step includes manually raking the layer of mixture to physically contact the aggregate with the rake for manually moving some of the aggregate to said projecting dispositions.

10. The method of claim 8, wherein the aggregate and the binder of said mixture are heated before being applied in said layers and wherein a coating of hot elastomeric binder material is applied over each layer after the latter is applied in the channel and before said aggregate is physically positioned to project upwardly, whereby said coating fills whatever voids may exist in the mixture layer.

* * * * *